US005324110A

United States Patent [19]

Kato

[11] Patent Number: 5,324,110

[45] Date of Patent: Jun. 28, 1994

[54] AGITATING DEVICE WITH BAFFLE

[75] Inventor: Kohichi Kato, Warabi, Japan

[73] Assignee: Satake Chemikal Equipment Mfg., Ltd., Moriguchi, Japan

[21] Appl. No.: 68,617

[22] Filed: May 27, 1993

Related U.S. Application Data

[63] Continuation of Ser. No. 905,314, Jun. 29, 1992, abandoned.

[30] Foreign Application Priority Data

Oct. 28, 1991 [JP] Japan ..... 3-095901

[51] Int. Cl.[5] ..... B01F 5/12

[52] U.S. Cl. ..... 366/270; 366/307

[58] Field of Search ..... 366/65, 262, 263, 265, 366/270, 279, 302, 307, 325, 174, 253, 264; 261/83, 84, 91, 93, 123; 415/208.1

[56] References Cited

U.S. PATENT DOCUMENTS

| | | | |
|---|---|---|---|
| 444,345 | 1/1891 | Gabbett | 366/265 |
| 531,718 | 1/1895 | Detwiler et al. | 366/302 |
| 727,032 | 5/1903 | Tubbs | 366/307 X |
| 950,152 | 2/1910 | Gaar | 366/307 X |
| 975,380 | 11/1910 | Berntson | 366/307 X |
| 1,181,205 | 5/1916 | Arnold | 366/302 X |
| 2,871,109 | 1/1959 | Snyder et al. | 366/265 X |
| 2,950,171 | 8/1960 | Macq | 366/270 X |
| 3,149,888 | 9/1964 | Lennon | 366/285 X |
| 3,404,870 | 10/1968 | Multer | 366/307 |
| 3,638,919 | 2/1972 | Phipps | 366/262 |
| 4,175,869 | 11/1979 | Churlaud | 366/65 X |
| 4,483,624 | 11/1984 | Bacon, Jr. et al. | 366/263 X |
| 4,944,595 | 7/1990 | Hodson | 366/265 X |
| 5,078,505 | 1/1992 | Nyman et al. | 366/262 |

FOREIGN PATENT DOCUMENTS

| | | | |
|---|---|---|---|
| 2366869 | 6/1978 | France | 366/307 |
| 1567256 | 5/1990 | U.S.S.R. | 366/307 |

*Primary Examiner*—Philip R. Coe
*Assistant Examiner*—Charles Cooley
*Attorney, Agent, or Firm*—Oblon, Spivak, McClelland, Maier & Neustadt

[57] ABSTRACT

An agitating device includes substantially cylindrical tank having a depth greater than a diameter. An elongate plate-like baffle is mounted to an inner peripheral wall of the tank, a bottom end of the baffle terminating above the bottom of the tank to create a space between the bottom end of the baffle and the bottom of the tank. A shaft extends into the tank into a position adjacent to the baffle. The shaft is offset from the central axis of the tank and is spaced from the peripheral walls by a distance no greater than about the same distance as that separating the center of the tank from the baffle. An agitating vane is mounted to the shaft. The shaft is rotated in a direction such that a blade of the vane causes fluid in the tank to move axially along the baffle.

3 Claims, 2 Drawing Sheets

AGITATING DEVICE WITH BAFFLE

This application is a continuation of application Ser. No. 07/905,314 filed on Jun. 29, 1992, now abandoned.

BACKGROUND OF THE INVENTION

1. Field of the Invention

This invention relates to an agitating vane in a relatively deep tank of the type which is used in food industries or chemical industries or the like, for example a tank having a depth greater than its diameter.

2. Description of the Related Art

As this kind of conventional agitating device, as shown in FIGS. 5 and 6, there is known a device in which a plurality of baffles (b)...(b) are disposed at an inner wall of a tank (a), a long rotary shaft (c) is suspended at a central part of the tank (a) and a plurality of agitating vanes ($d_1$), ($d_2$) and ($d_3$) are fixed to the shaft.

According to this known agitating device, agitation was carried out as shown by arrows at each of the agitating vanes $d_1$, $d_2$ and $d_3$, so that agitation between an upper layer and a lower layer was hardly carried out and, in case particles in the liquid were heavy, the particles were easily settled at the lower layer part. At the same time, it was necessary to make a strong rotary shaft, the agitating device was large in size and its cost was high.

SUMMARY OF THE INVENTION

It is an object of the present invention to perform agitation of liquid at an upper part and a lower part easily by a single agitating vane without increasing a rotational power of a rotary shaft, to make a small-sized, less-expensive device and to simplify its maintenance and repair.

In order to accomplish the aforesaid objects, the present invention has a feature that the rotary shaft having an agitating vane fixed thereto is suspended at a peripheral part in a tank and a long baffle is disposed at an inner surface of the tank near the agitating vane.

According to another feature of the invention, an agitating device comprises a substantially cylindrical tank having an axial depth greater than a diameter thereof. An elongate plate-like baffle has a long side mounted to an inner peripheral wall of the tank such that the baffle extends substantially along the axis of the tank and radially toward the center of the tank, a bottom wall of the baffle terminating above the bottom of the tank. A shaft extends axially into the tank at a position adjacent the peripheral wall of the baffle. A vane is mounted to the shaft and means are provided for rotating the shaft in a direction such that a blade of the vane is moving in a direction toward the baffle when the blade is at a position closest to the peripheral wall, so that a fluid in the tank is caused to move axially along the baffle.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
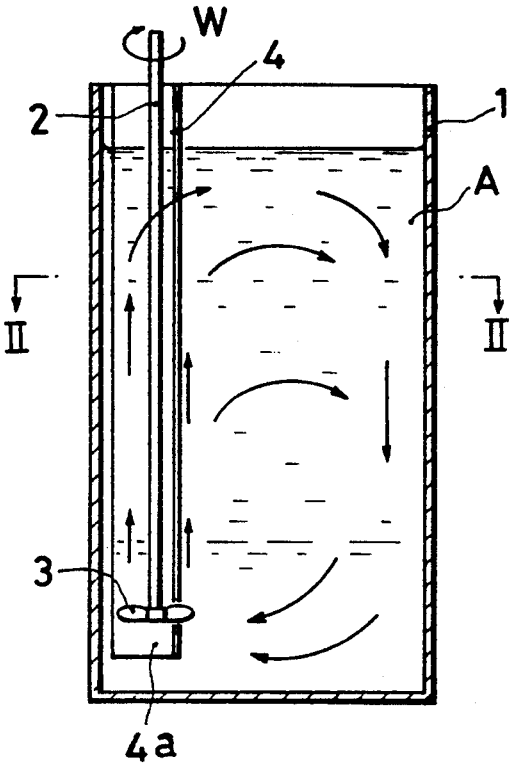
FIG. 1 is a longitudinal section of the first preferred embodiment of the present invention.
Figure 2:
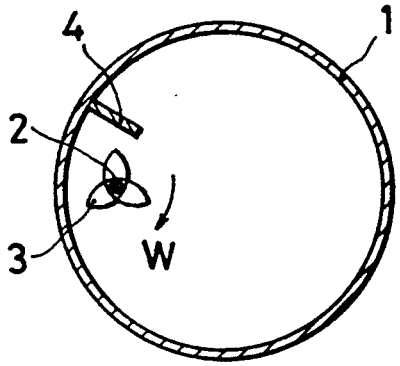
FIG. 2 is a sectional view taken along a line II—II of FIG. 1.

Referring now to FIGS. 1 and 2, the first preferred embodiment of the present invention will be described.

A substantially cylindrical tank 1 is relatively deep, i.e., the depth is greater than its diameter. It contains a rotary shaft 2 extending axially thereinto. The rotary shaft 2 is rotated by a rotating device (not shown) in a direction indicated by an arrow W, is suspended at an inner peripheral wall of the tank 1 and extends to near a bottom part of the tank 1.

An agitating vane 3 is fixed to an extreme lower end of the rotary shaft 2 so as to suck up the liquid A during rotation W of the rotary shaft 2.

A baffle 4 is comprised of a belt-like flat plate. A long side of the baffle is fixed to an inner wall of the tank from which the baffle radially inwardly extends toward the center of the tank. A clearance is provided between the bottom part 4*a* of the baffle and the bottom surface of the tank 1. The shaft 2 is spaced from the peripheral wall of the tank 1 by a distance which is no greater than about the distance by which the baffle extends radially into the tank. The baffle 4 is placed near the agitating vane 3 such that the agitated liquid flow is into impingement with the baffle, i.e., such that the blades of the vane are moving toward the baffle when the blades are nearest the peripheral wall of the tank during rotation in direction W.

Operation of this embodiment will now be described. As the agitating vane 3 is rotated in a direction W due to the rotation of the rotation shaft 2, the liquid A at the bottom part of the tank 1 is sucked up and caused to ascend in a flow along the upstream surface of the baffle 4, as indicated by an arrow. This flow then descends along the inner wall of the tank 1 at a position substantially diametrically opposite the baffle. The liquid is thus circulated.

Since there is a clearance at a lower end of the baffle 4, the liquid A at the bottom part of the tank 1 on both sides of the baffle is positively sucked up and caused to ascend.

In this way, a uniform agitation is carried out even if the tank 1 is deep.

Figure 3:
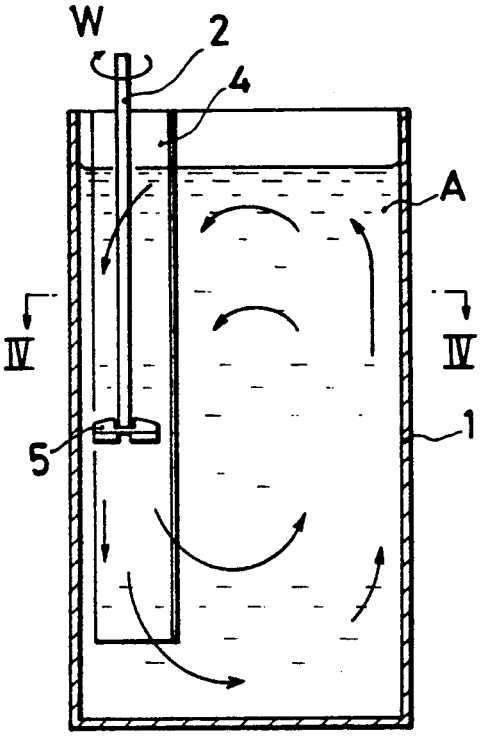
FIG. 3 is a longitudinal section of the second preferred embodiment of the present invention.
Figure 4:
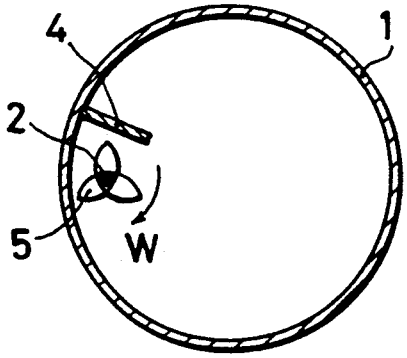
FIG. 4 is a sectional view taken along a line IV—IV of FIG. 3.
Figure 5:
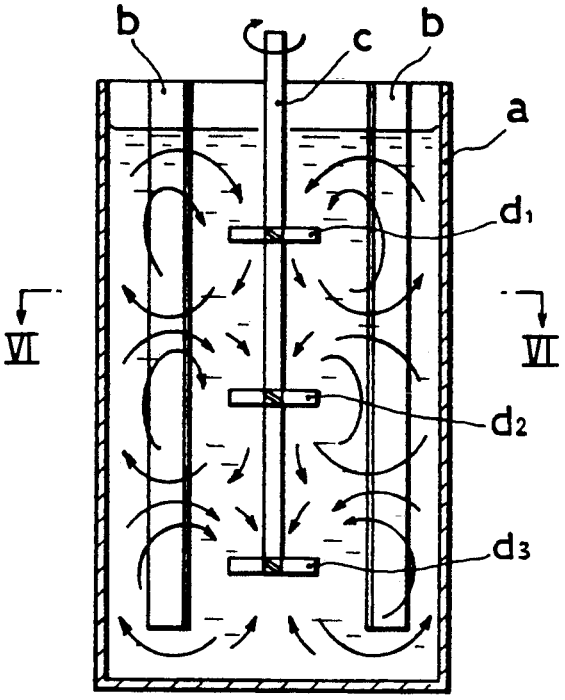
FIG. 5 (PRIOR ART)
FIG. 5 is a longitudinal section of a known agitating device.
Figure 6:
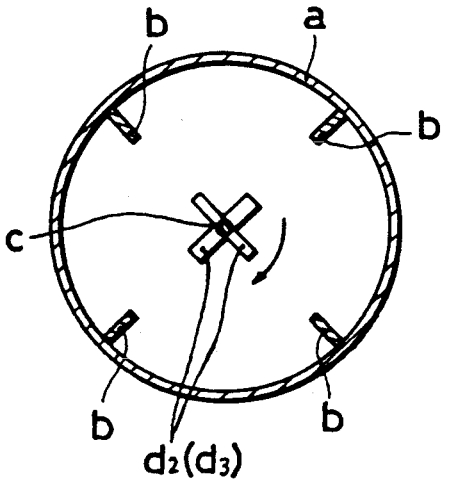
FIG. 6 (PRIOR ART)
FIG. 6 is a sectional view taken along a line VI—VI of FIG. 5.

FIGS. 3 and 4 illustrate the second preferred embodiment of the present invention. In this case, an agitating vane 5 is formed for a high speed liquid flow and at the same time the height of the agitating vane 5 is set at a central part of the tank. The vane is again disposed at a peripheral part of an inner wall of the tank 1.

In case of the aforesaid assembly, as the rotary shaft 2 having the agitating vane 5 is rotated in a direction W, the liquid A descends in the direction of the arrow in a high speed flow, strikes against the bottom surface of the tank 1, is repelled and then ascends at a diametrically opposite side of the tank. At the same time, the liquid A is rapidly circulated and agitation is carried out.

The shape of the baffle 4, an angular relation between the baffle 4 and the tank 1, and the clearance in respect to the bottom surface can be properly changed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A agitating device comprising:

a substantially cylindrical tank having a central vertical axis and an axial depth greater than a diameter thereof;

an elongate plate-like baffle having a long side mounted to an inner peripheral wall of the tank such that the baffle extends substantially vertically and extends radially toward the center of the tank by a predetermined distance, a bottom end of the baffle terminating above the bottom of the tank to create a space between the bottom end of the baffle and the bottom of the tank;

a shaft extending into the tank at a position adjacent the baffle, said shaft being offset from the central axis of the tank and being spaced from the peripheral wall by a distance no greater than about said predetermined distance;

an agitating vane mounted to the shaft; and means for rotating said shaft in a direction such that a blade of the vane is moving in a direction toward the baffle when the blade is at a position closest to the peripheral wall, whereby a fluid in the tank is caused to move along the baffle.

2. A agitating device according to claim 1 wherein said agitating vane is positioned slightly above the bottom end of said baffle.

3. An agitating device according to claim 1, wherein said agitating vane is positioned at a central part of the tank.

* * * * *